US005139309A

United States Patent [19]

Kornreich

[11] Patent Number: 5,139,309

[45] Date of Patent: Aug. 18, 1992

[54] COMBINED WHEELCHAIR AND TRAY ASSEMBLY

[76] Inventor: David Kornreich, 3948 Carrel Blvd., Oceanside, N.Y. 11572

[21] Appl. No.: 715,425

[22] Filed: Jun. 14, 1991

[51] Int. Cl.[5] ..... A47C 7/70

[52] U.S. Cl. ..... 297/194; 297/145; 297/162; 297/DIG. 4

[58] Field of Search ..... 297/145, 155, 162, 194, 297/DIG. 4; 16/366

[56] References Cited

U.S. PATENT DOCUMENTS

| | | | |
|---|---|---|---|
| 83,760 | 11/1868 | Carkeet | 16/366 |
| 936,017 | 10/1909 | McClelland | 297/162 |
| 3,301,406 | 1/1967 | Scott | 211/88 |
| 3,632,161 | 1/1972 | Arfaras | 297/145 |
| 3,662,982 | 5/1972 | Antonius | 248/309 |
| 3,712,668 | 1/1973 | Fink | 297/162 |
| 3,999,798 | 12/1976 | Roulier | 297/150 |
| 4,223,944 | 9/1980 | DeLong | 297/148 |
| 4,403,786 | 9/1983 | Ulics | 280/289 |
| 4,428,616 | 1/1984 | Hamilton | 297/145 |
| 4,575,149 | 3/1986 | Forestal et al. | 297/194 |
| 4,632,451 | 12/1986 | Lee | 297/153 |
| 4,662,676 | 5/1987 | Havelock | 297/194 |
| 4,685,726 | 8/1987 | Wolpert, Jr. | 297/162 X |
| 4,705,287 | 11/1987 | Cumbie | 280/289 |
| 4,795,211 | 1/1989 | Stern et al. | 297/194 |
| 4,848,833 | 7/1989 | Grall | 297/162 |

FOREIGN PATENT DOCUMENTS

| | | | |
|---|---|---|---|
| 512281 | 4/1976 | U.S.S.R. | 16/366 |
| 5478 | 9/1987 | World Int. Prop. O. | 297/162 |

*Primary Examiner*—Peter R. Brown
*Attorney, Agent, or Firm*—Heslin & Rothenberg

[57] ABSTRACT

The tray assembly for mounting to a wheelchair includes a tray having a top surface and bottom surface, a member for supporting the tray to an arm rest of the wheelchair, the member being mountable on the arm rest of the wheelchair, and a double hinge for pivotably affixing the tray surface to the member for supporting the tray surface. The double hinge has a first and second pivotal axis where pivotal movement of the tray from the use position to an intermediate position occurs about a first pivotal axis and pivotal movement of the tray from an intermediate position to a storage position occurs about the second pivotal axis. The tray assembly enables the tray surface to extend on the outerside on the arm rest and allows the tray to be folded into a non-use position alongside the wheelchair.

4 Claims, 4 Drawing Sheets

FIG. 4
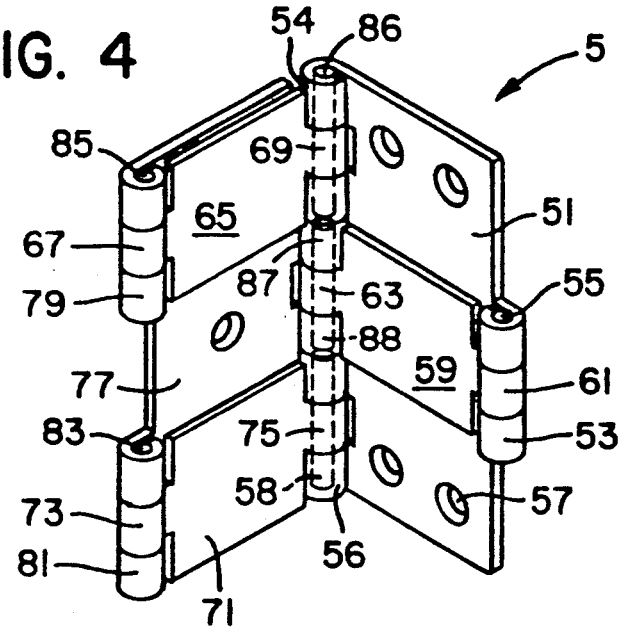
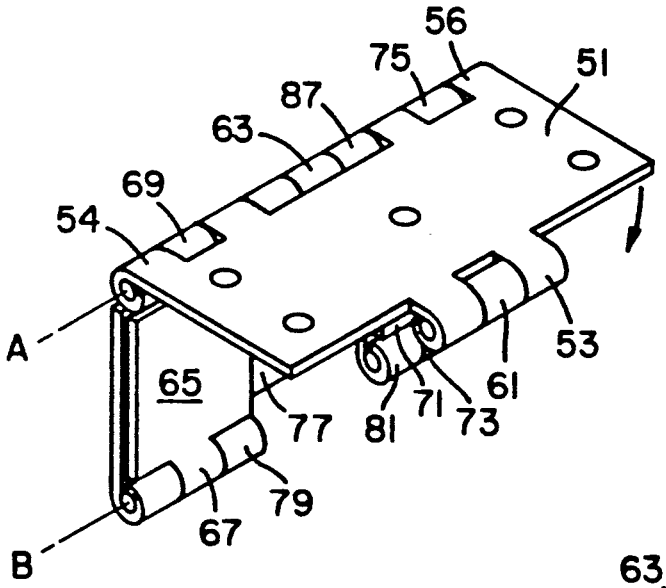
FIG. 5A
FIG. 5B
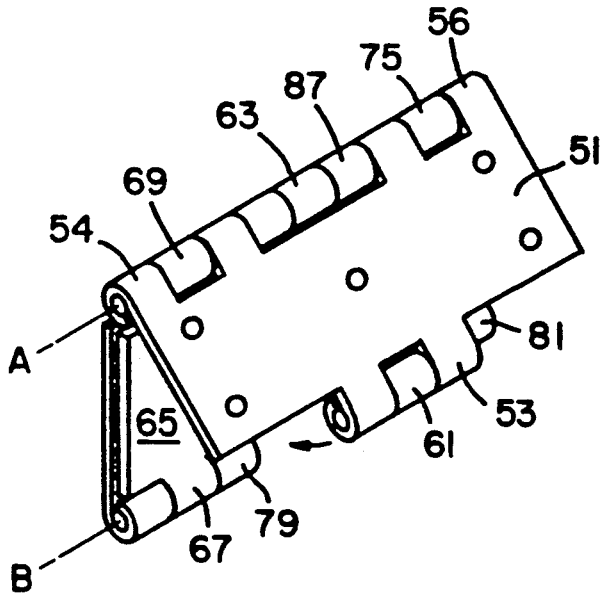

COMBINED WHEELCHAIR AND TRAY ASSEMBLY

BACKGROUND OF THE INVENTION

This invention relates to the field of attachments for wheelchairs and, more particularly, to a combined wheelchair and desk assembly.

Persons confined in wheelchairs often find the need to utilize trays in order to perform certain tasks. For example, if a person confined to a wheelchair desires to write, it is often necessary to provide a flat surface upon which the person may support a writing surface. Also, persons confined in wheelchairs may require a place to put their food while eating, since it is often not possible to place conventional trays on top of these wheelchairs or merely place the wheelchairs underneath a conventional table. Therefore, it is desirable to provide a tray assembly for a wheelchair which may be removably secured to a wheelchair thereby enabling the person confined to a wheelchair to utilize the tray assembly to perform various tasks without the necessity for utilizing furniture or other persons for assistance.

Various tray and/or desk assemblies for wheelchairs exist. However, there are various shortcomings associated with these currently available wheelchair tray assemblies. Certain types of tray assemblies cannot be placed in a storage or non use position while they are mounted on either one of, or both of, the arm rest of the wheelchair. For example, U.S. Pat. No. 4,632,451 teaches a wheelchair table and desk attachment which cannot be placed in a position where the desk surface remains attached to the wheelchair assembly when not in a position for use, i.e., across the arm rest of the wheelchair.

U.S. Pat. No. 3,999,798, discloses a tray assembly for a wheelchair which may be folded in half. The tray may also be pivoted about a hinge which is affixed to an arm rest so as to be placed in a position of non-use while still attached to the wheelchair arm rest. The problem with this configuration, however, is that the construction of the tray assembly, although allowing pivoting into a non-use position, does not allow for the tray surface to protrude on the outside of the arm rest. If the tray surface were to protrude outside the arm rest, the tray would not be able to pivot about the arm rest and be placed in a storage position. Because the desk surface does not protrude on the outside of the arm rest assembly, a person confined in a wheelchair may not have sufficient area on the desk surface to rest his forearm and/or elbow. Therefore, the only place to rest the forearm and/or elbow is on the arm rest and/or portion of the tray on the inside of the arm rest. This often is insufficient, uncomfortable and inconvenient and therefore causes the person's arm to often slip off the tray surface and/or arm rest thereby limiting the person's use of the desk and/or tray assembly.

It is therefore an object of the present invention to provide a tray assembly which may be mounted to the arm rest of a wheelchair and which contains a surface area of the tray assembly that protrudes on the outer side of the arm rest.

It is also an object of the present invention to provide a combined wheelchair and tray assembly which may be folded from a use position into a storage position, alongside the arm rest of the wheelchair, but does not impede the wheel of the wheelchair thereby enabling the wheelchair to be moved while the tray assembly is in the storage position.

SUMMARY OF THE INVENTION

The aforementioned objects and additional benefits are realized, by providing in a combined wheelchair and tray assembly in accordance with the principles of the present invention.

The combined wheelchair and tray assembly includes a tray having a top surface and bottom surface, a means for supporting the tray to an arm rest of a wheelchair, the means being mountable on the arm rest of the wheelchair, and a double hinge means for pivotably affixing the tray surface to the means for supporting the tray surface. The double hinge means has a first and second pivot axis wherein pivotal movement of the tray from a use position to an intermediate position occurs about the first pivot axis and pivoting movement of the tray from the intermediate position to a storage position occurs about the second pivot axis. The means for supporting the tray surface to the arm rest may comprise a channel member sized to be slideably mounted onto the arm rest of the wheelchair. The channel member may comprise a top surface, a first side surface and a bottom surface. The bottom surface may have a groove extending throughout its length, the length being sized to allow the channel member to be slideably mounted on the arm rest and over a support for the wheelchair arm. The double hinge means may comprise a two-way hinge and the two-way hinge may be mounted to the first side surface of the channel member and mounted to the bottom of the desk surface.

BRIEF DESCRIPTION OF THE DRAWINGS

FIG. 4 depicts a two-way hinge useable in the tray assembly depicted in FIG. 3 in accordance with the principles of the present invention; and FIGS. 5A–5E depict the two-way hinge depicted in FIG. 4 shown in various positions which correspond to the tray positions depicted in FIGS. 3A–3E.

DETAILED DESCRIPTION

Figure 1:
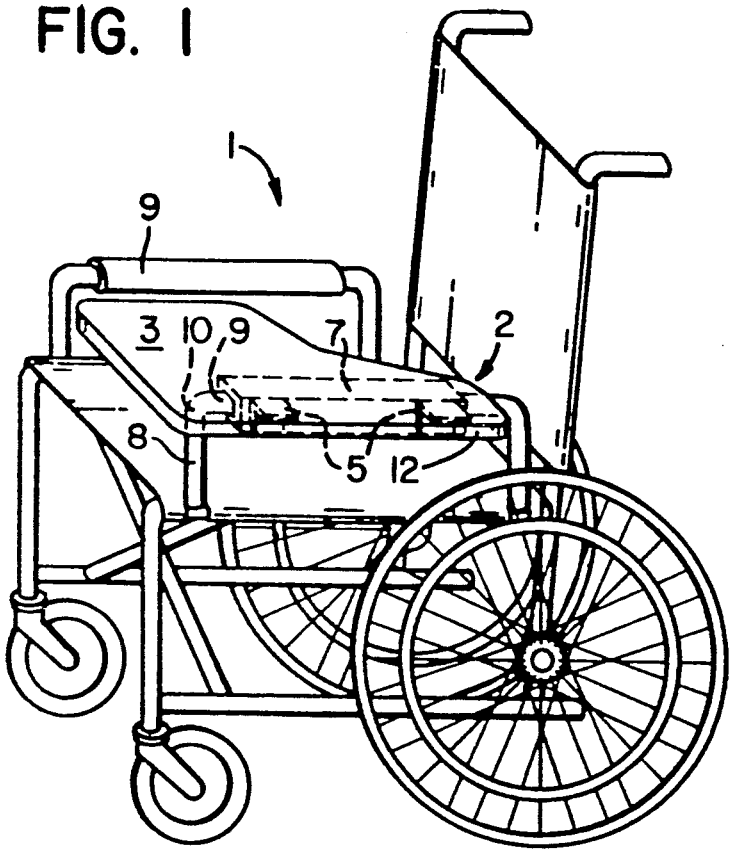
FIG. 1 depicts a combined wheelchair and tray assembly constructed in accordance with the principles of the present invention having the tray assembly folded in the use position.

A combination wheelchair 1 and tray assembly, generally denoted 2 is shown in FIG. 1. The tray assembly 2 contains a tray 3, a double hinge means 5 and a channel member 7 useable as a means for supporting the tray to the arm rest 9 of the wheelchair 1.

As shown in FIG. 1, the tray assembly 2 is mounted on the arm rest 9 of the wheelchair 1. The tray 3, is folded into a use position, i.e., a position where a person confined to the wheelchair would use the tray for various functions. The tray 3 may be pivoted about a pair of hinge means 5 into a non-use or storage position, as shown in FIG. 2.

Figure 2:
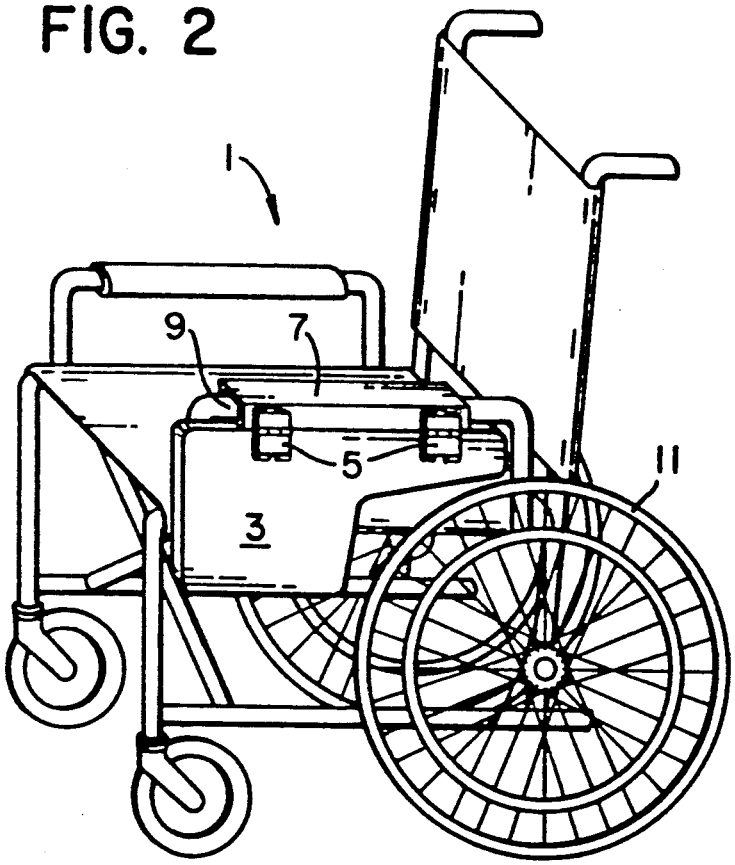
FIG. 2 is a combined wheelchair and tray assembly constructed in accordance with the principles of the present invention as depicted in FIG. 1, having the tray assembly folded in a FIGS. 3A–3E depict a tray assembly constructed in accordance with the present invention having the tray folded in the use, intermediate, and non-use positions.

Referring now to FIGS. 1–3, the tray 3 has the general configuration depicted therein. The portion of the tray assembly located near the back of the wheelchair is narrower in width than the front portion of the tray 3 nearest to the front edge of the seat of the wheelchair. This configuration provides ample room for a person within the wheelchair to sit therein, while the desk is in the use position of FIG. 1, as well as sufficient desk surface area. Although a tray configuration as depicted herein is preferred, other various tray configurations may be used in accordance with the principles of the present invention and the invention is not limited thereto.

The channel member 7, having a top portion 101 and a side portion 103, is used to support the tray 3 to the arm rest 9 of the wheelchair 1. The channel member 7 has a groove 105 extending lengthwise therethrough at the bottom surface 107. As shown in FIGS. 1 and 2, the tray assembly is mounted to the wheelchair by sliding the channel member over the arm rest 9. The channel member can be placed over the arm rest 9, the arm rest support 8 and elbow 10 by sliding the groove 105 past the arm rest support 8, elbow 10 and over the arm rest 9. The channel member 7 may be sized such that the groove 105 and the dimensions of the top portion, side portion and bottom portions enable the tray assembly to fit securely over the arm rest 9 of the wheelchair 1. Although the channel member 7 may be used as the means for supporting the tray assembly to the arm rest 9 of the wheelchair, other various means may be used to accomplish the same results, and the invention is not limited thereto. For example, instead of a channel member, a clamping mechanism or means may be used to attach the tray assembly and double hinge means to the arm rest 9 of the wheelchair. However, the channel member is preferred because it may easily be mounted and/or dismounted to the wheelchair by sliding the channel member 7 over the arm rest 9.

The tray 3 is mounted to the channel member 7 by double hinge means 5. As described in detail, infra, the outer faces of the hinge means 5 are affixed to the underside of the tray 3 and the side portion 103 of the channel member, respectively. The channel member 7 should be sized, and the double hinge means positioned thereon such that when the tray assembly is affixed to the arm rest 9, the tray 3 may be folded into the non-use position depicted in FIG. 3E. Preferably, in this position, the underside of the tray 3 should be flush with side portion 103 of the channel member. Also, in this position, the tray should not interfere with the wheelchair structure.

Figure 3C:
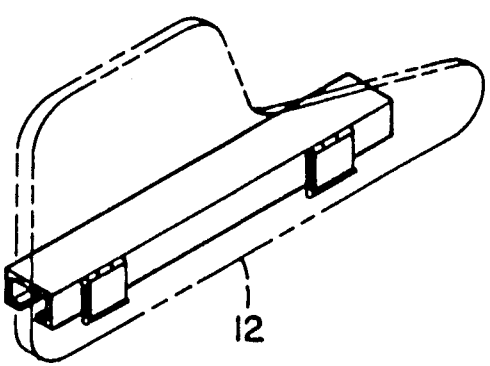
Figure 3B:
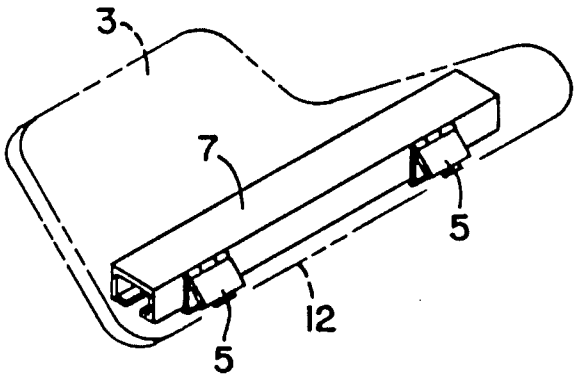
Figure 3A:
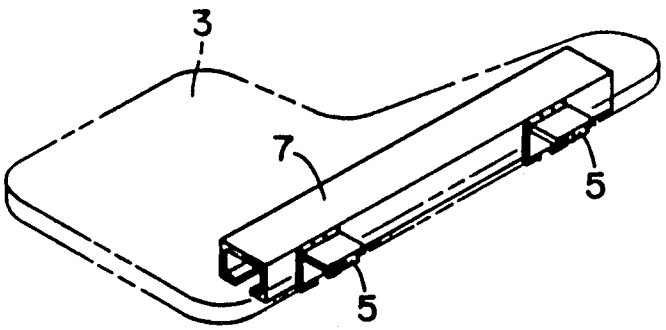
Figure 3D:
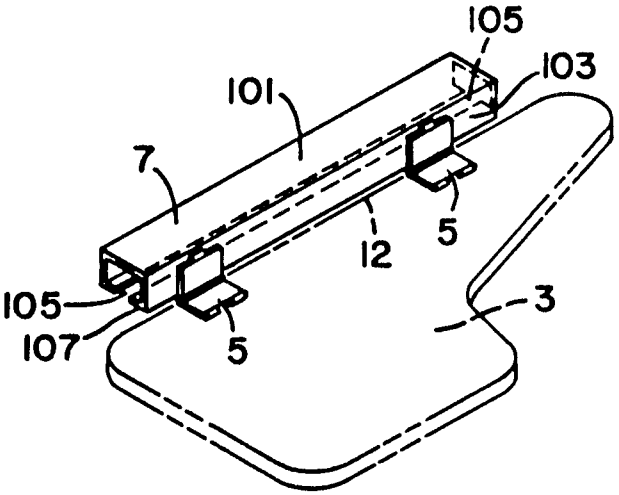
Figure 3E:
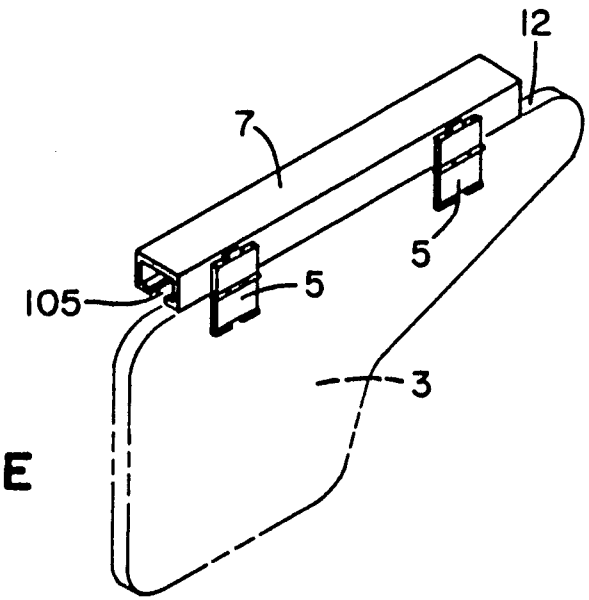

Referring now to FIGS. 3A-3E, the double hinge means 5 enables the tray assembly to be folded into the position depicted in FIG. 3A and unfolded into each of the various positions depicted in FIGS. 3B-3E. As shown in FIG. 3A and 3B, tray 3 is pivoted about a first axis of the hinge member 5. By pivoting the tray assembly 3 in such a manner, the tray assembly may be placed into an intermediate position, depicted in FIG. 3C. A further pivoting of the tray assembly 3 in a clockwise rotation, referenced in FIGS. 3A-3E, enables the tray 3 to be pivoted about a second axis as depicted in FIG. 3D. Pivoting the tray 3 about the second axis may allow the tray 3 to be unfolded into a storage or non-use position depicted in FIG. 3E.

A two-way hinge is depicted in FIG. 4 which comprises the double hinge means 5. The two-way hinge 5 contains a variety of different hinge pins, bearings and faces. A first outer face 51 contains an integral cylindrical portion 53 on one edge thereof and second and third cylindrical portions 54, 56, respectively, located at the opposite edge thereof. These cylindrical portions each have a void therein for receiving a complimentary cylindrical portion which together act as bearings for allowing pivotal movement therebetween. Each of these cylindrical portions contains a hinge pin, 86, 55, 58 concentrically oriented therein, which acts as a pivot member.

The second outer face 77 also contains integral cylindrical portions 79, 81, which exist on the first edge of the second outer face 77 and a third cylindrical portion 87 integrally formed on the inner edge of the second outer face 77. Each of the cylindrical portions has a void therein for receiving a complimentary cylindrical portion which together act as bearings for allowing pivotal movement therebetween. Each cylindrical portion contains a hinge pin 83, 85, 88 therein. The first and second outer face are oriented as a conventional hinge. However, the cylindrical portions do not contain a single hinge pin therein, as does a conventional hinge.

Three intermediate faces 59, 71, 65 are each located within the two-way hinge. First intermediate face 65 contains a first integral cylindrical portion 67 end and second cylindrical portion 69 on its second end. The first cylindrical portion 67 is located within the empty space of the cylindrical member 79 of the second outer face 77 and is concentrically oriented with the cylindrical member 79 about hinge pin 85. The second cylindrical portion 69 of the first intermediate face is located within the void of integral cylindrical portion 54 and concentrically oriented with the cylindrical portion 54 about pin 86. A second intermediate face 59 also contains two cylindrical portions 61, 63 integrally configured on each end. The first cylindrical portion 61 is located within the void of the cylindrical portion 53 of the first outer face and is concentrically oriented with the cylindrical portion 53 about pivot member 55. The second cylindrical portion 63 is located within the void of the cylindrical portion 87 of the second outer face 77 and is concentrically oriented with the cylindrical portion 87 about pivot member 88. A third intermediate face 71 also contains cylindrical members 73, 75 integrally formed on each end. The first cylindrical member 73 is located within the void of the cylindrical portion 81 of the second outer face 77 and is concentrically oriented with the cylindrical portion 81 about pivot 83. The second cylindrical portion 75 of the third intermediate face 71 is located within the void of the cylindrical member 56 of the first outer face 51 and is concentrically oriented along with the cylindrical portion 56 about pivot 58.

Figure 5C:
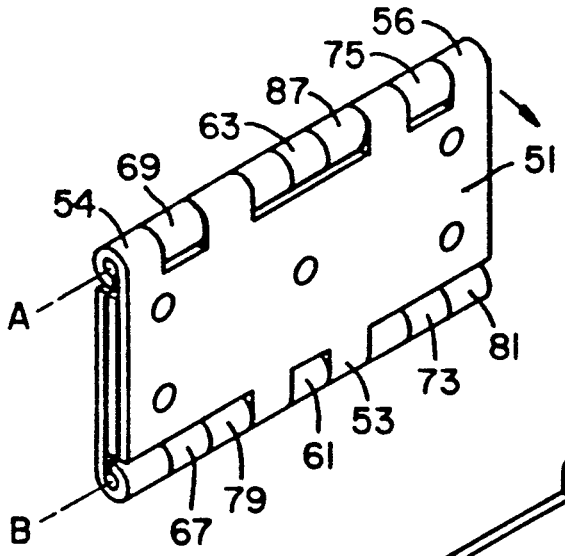
Figure 5D:
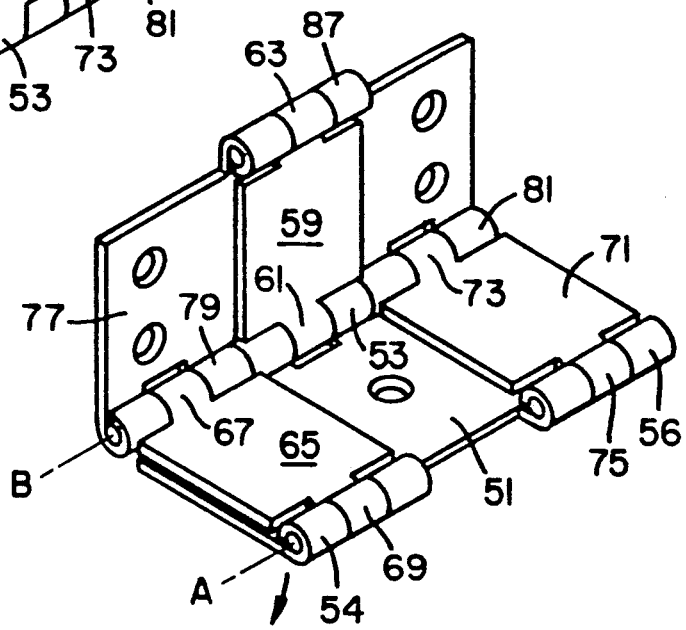
Figure 5E:
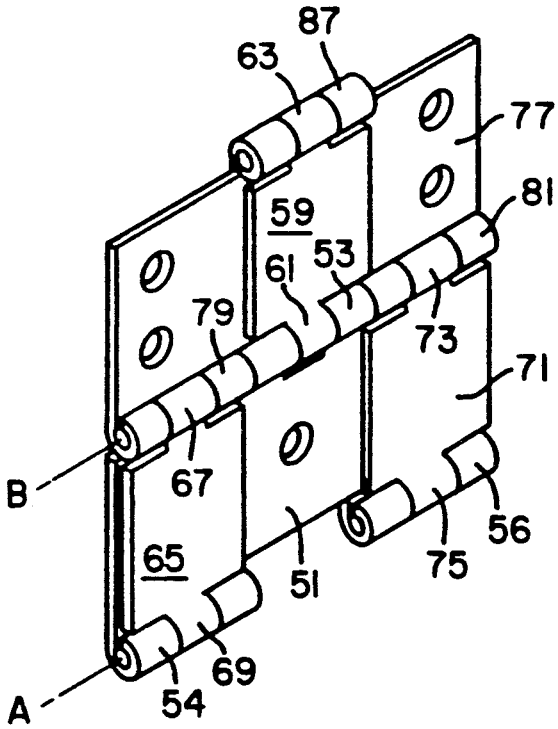

Referring now to FIG. 5C, if the two-way hinge 5 is closed, cylindrical members 54, 69, 63, 87, 75, 56 are axially oriented about a first pivot axis A, and cylindrical members 67, 79, 61, 53, 73, 81 are axially oriented about a second pivot axis B. As shown in FIGS. 5A and 5B the outer faces 51, 77 pivot relative to each other about the first axis A to a closed position, but may also pivot about axis B into an open position, as shown in FIGS. 5D and 5E. Referring again to FIGS. 3A-3E, the tray assembly 3 is mounted to the first outer face 51 while the side portion 103 of the channel member 7 is mounted to the second outer face 77. When the tray assembly is folded into the intermediate position, depicted in FIG. 3C, the first, second, and third intermediate faces 65, 59, 71, respectively, are located in between the first outer face 51 and second outer face 77.

Operation of the two-way hinge 5 will be described with reference to FIGS. 5A-5E. Referring now to FIG.

5A, a two-way hinge is oriented at a 90° angle corresponding to the position of the two-way hinge 5 when the tray assembly 2 is in the use position depicted in FIGS. 1 and 3A. In this position, the tray 3 is affixed to the outer side of the first outer surface 51. The outer side of the second outer surface 77 is affixed to the side portion 103 of the channel member 7. When folding the tray assembly 2 into the position depicted in FIG. 3B, the two-way hinge 5 is pivoted clockwise into the position depicted in FIG. 5B. Continuing to pivot the two-way hinge 5 clockwise will enable the hinge to be placed in the position depicted in FIG. 5C whereby the tray assembly is in the intermediate position depicted in FIG. 3C. During the clockwise pivot of the tray assembly, the two-way hinge 5 pivots about its first axis A until the two-way hinge is in the intermediate position depicted in FIG. 3C. In this position, the tray 3 is substantially perpendicular to the surface upon which the wheelchair 1 is placed and substantially parallel to the wheels of a wheelchair.

When the tray assembly 2 is in the intermediate position, the tray 3 may be pivoted in a clockwise rotation about the channel member 7 so that the tray assembly 2 is in the position depicted in FIG. 3D. The two-way hinge will then be in the position depicted in FIG. 5D. The movement of the two-way hinge from the position depicted in FIG. 5C into the position depicted in FIG. 5D involves the pivoting of hinge components about second pivot axis B. In this movement, the first outer face 51, the first intermediate face 65 and third intermediate face 71 each pivot clockwise, relative to second outer face 77 and second intermediate face 59, about second pivot axis B. The construction of the hinge member, as shown in FIG. 4, enables the two-way hinge 5 to be pivoted in such manner. Continuing to pivot the tray from the position depicted in FIG. 3D into the non-use or storage position depicted in FIG. 3E involves pivoting the tray 3 and hinge member into the position depicted in FIG. 5E such that the first outer face 51, the first intermediate face 65 and third intermediate face 71 pivot relative to second pivot axis B.

It is preferred that a two-way hinge such as that shown in FIG. 4, and described herein, be used in accordance with the principles of the present invention. However, it is possible that other two-way hinge mechanisms may also be used to accomplish the principles of the present invention. Use of the two-way hinge depicted in FIG. 4 enables the outer edge 12 of the tray 3 to be mounted such that it can extend past the outermost cylindrical portion 53 of the first outer face 51 by a distance no greater than that by which pivot axis B extends past the bottom 107 of the channel. Such a configuration enables the width of the desk to protrude substantially over the support member thereby giving the person in a wheelchair more room to rest his or her elbow. The configuration and construction of the tray assembly also enables the tray with the expanded surface area to be folded into the non-use position.

The two-way hinge 5 may generally be manufactured of any suitable material. Typically, however, the material may be manufactured of a carbon or stainless steel. The hinge pins 55, 58, 83, 85, 86, 88 may be sized to be press fit within the cylindrical portions of the hinge faces so that pivoting of the hinge about either first axis A or first axis B is met with a resistive torque. The effect is that the hinge portion will not pivot without a force being applied thereto. Alternatively, the hinge portions may be spring loaded which will thereby require a sufficient force to open or close the hinge about either pivot axis A or pivot axis B.

The tray 3 may be also manufactured of any suitable material such as wood, plastics, or metal. Preferably, however, clear plastic such as Lexan® or wood are preferred for use in the present invention. The channel member 7 may be made of aluminum or steel. However, various other materials such as plastic or wood may also suffice.

Although the invention has been described in reference to the embodiments depicted herein, it is readily apparent to one skilled in the art that various changes may be made to the invention without departing in any way from the spirit of the invention. Any such changes are intended to be within the scope of the invention as defined by the following claims.

I claim:

1. A tray assembly for mounting to a wheelchair with a seat, wheels and arm rest structure comprising:

a tray having a top surface and bottom surface;

a means for supporting said tray to said arm rest, said means being mountable on the arm rest of a wheelchair; and a double-hinge means for pivotably affixing said tray surface to said means for supporting said tray surface, said double hinge means having a first and second pivotal axis being parallel to one another wherein pivotal movement of the tray from a use position having an edge of the tray protruding laterally beyond the arm rest of the wheelchair and the top surface of the tray facing up, to an intermediate position having the top surface of the tray facing outwardly above the arm rest occurs about said first pivotal axis, and pivotal movement of the tray from the intermediate position to a storage position having the top surface of the tray facing inwardly below the arm rest occurs about said second pivotal axis.

2. The tray assembly according to claim 1 wherein the means for supporting said tray surface to said arm rest comprises a channel member sized to be slidably mounted onto the arm rest of a wheelchair.

3. The tray assembly according to claim 2 wherein the channel member comprises a top surface, a first side surface and a bottom surface, said bottom surface having a groove extending throughout its length, said groove being sized to allow the channel member to be slidably mounted over an arm rest support of the wheelchair on the arm rest.

4. The tray assembly according to claim 3 wherein the double-hinge means is mounted to the first side surface of the channel member and mounted to the bottom of the tray.

* * * * *